US009322408B2

(12) United States Patent
Tsai et al.

(10) Patent No.: US 9,322,408 B2
(45) Date of Patent: Apr. 26, 2016

(54) CENTRIFUGAL FAN

(71) Applicant: DELTA ELECTRONICS, INC., Taoyuan Hsien (TW)

(72) Inventors: Po-Jeng Tsai, Taoyuan Hsien (TW); Te-Fu Chen, Taoyuan Hsien (TW)

(73) Assignee: DELTA ELECTRONICS, INC. (TW)

( * ) Notice: Subject to any disclaimer, the term of this patent is extended or adjusted under 35 U.S.C. 154(b) by 480 days.

(21) Appl. No.: 13/960,223

(22) Filed: Aug. 6, 2013

(65) Prior Publication Data

US 2014/0314558 A1 Oct. 23, 2014

(30) Foreign Application Priority Data

Apr. 17, 2013 (CN) ..... 2013 1 0134464

(51) Int. Cl.
*F04D 29/44* (2006.01)
*F04D 25/06* (2006.01)
*F04D 29/42* (2006.01)

(52) U.S. Cl.
CPC ..... *F04D 25/0613* (2013.01); *F04D 29/422* (2013.01); *F04D 29/4226* (2013.01)

(58) Field of Classification Search
CPC ..... F05D 2260/608; F05D 2260/605; F04D 17/16; F04D 17/162; F04D 29/4226; F04D 29/424; F04D 29/422; F04D 29/441; F04D 29/444
USPC ..... 415/117, 175, 176, 177, 178, 102, 204, 415/206, 208.3, 211.1, 211.2, 213.1, 214
See application file for complete search history.

(56) References Cited

U.S. PATENT DOCUMENTS 5,419,680 A * 5/1995 Asano ..... F04D 29/663 415/119
2005/0207886 A1* 9/2005 Chen ..... F04D 29/4233 415/206

FOREIGN PATENT DOCUMENTS

EP 1703138 A2 * 9/2006 ..... F04D 29/441
JP 10220398 A * 8/1998
JP 11324993 A * 11/1999
JP 2002257091 A * 9/2002
JP 2013044249 A * 3/2013
JP 2013057319 A * 3/2013

* cited by examiner

*Primary Examiner* — Patrick Maines
(74) *Attorney, Agent, or Firm* — Hauptman Ham, LLP

(57) ABSTRACT

A centrifugal fan includes a shell, an impeller, a tongue portion, and a protrusion. The shell includes a top plate, a bottom plate, and a sidewall connecting to the top plate and the bottom plate. The top plate, the bottom plate, and the sidewall define an air outlet. The impeller is disposed in the shell. The tongue portion is disposed in the shell and neighboring the air outlet. The protrusion is disposed on an inner wall of the shell and is physically connected to the top plate and the bottom plate.

19 Claims, 11 Drawing Sheets

CENTRIFUGAL FAN

RELATED APPLICATIONS

This application claims priority to China Application Serial Number 201310134464.7, filed Apr. 17, 2013, which is herein incorporated by reference.

BACKGROUND

1. Field of Invention

The present invention relates to a fan. More particularly, the present invention relates to a centrifugal fan.

2. Description of Related Art

In general, a heat-dissipating module is needed in portable electronic devices for the maximum heat-dissipating efficiency. However, because the development of portable electronic devices is toward miniaturization, there are less and less spaces reserved for natural convection within shells of the miniaturized devices. Therefore, the heat-dissipating module for the portable electronic devices has a trend to dissipate heat by forced convection generated from centrifugal fans.

In design of the centrifugal fans, a volute fan shell in the portable electronic devices is introduced to generate high hydrostatic pressure and high rotation speed of air, so as to overcome the issue about poor air convection due to the limited spaces within the shells of the miniaturized devices. However, when the wake flow generated by the blades of the fans hits a surface of a tongue portion, which is the compression section of the shell, the hit region becomes a noise source of narrow band. According to superposition principle, a blade frequency noise will be generated with a large amplitude and a fixed frequency.

In enhancing the heat-dissipating efficiency of the devices, the air amount has to increase as well. However, the increase in the flow field makes the wake flow disturbance by the blades of the fans more intense, resulting in a dilemma between the noise and the heat-dissipating efficiency.

SUMMARY

This disclosure provides a centrifugal fan with a protrusion, so as to reduce the noise made by the blade frequency.

In one embodiment, a centrifugal fan is provided. The centrifugal fan includes a shell, impeller, tongue portion, and a protrusion. The shell includes a top plate, a bottom plate, and a sidewall. The sidewall connects to the top plate and the bottom plate. The top plate, the bottom plate, and the sidewall define an air outlet. The impeller is disposed in the shell. The tongue portion is disposed in the shell and neighboring the air outlet. The protrusion is disposed on an inner wall of the shell and physically connected to the top plate and the bottom plate.

In one or more embodiments, the impeller has a central point C, and the tongue portion has a central point T. The protrusion is disposed in a range of 15 degrees to 195 degrees starting inwardly from a C-T connecting line.

In one or more embodiments, the protrusion is disposed in the range of 45 degrees to 150 degrees starting inwardly from the C-T connecting line.

In one or more embodiments, there is a minimum distance P between the tongue portion and the impeller. The shell has a width W. The impeller has a diameter D. A gap A is defined between the impeller and the protrusion, in which $0.5\times P\leq A\leq 0.7\times(W-D)$.

In one or more embodiments, the protrusion includes a vertex and two end points. The vertex is a point of the protrusion the nearest to the impeller, and the two end points are two ends of the protrusion the farthest to the impeller. The angle between two connecting lines of the two end points and the vertex is not larger than 160 degrees.

In one or more embodiments, the vertex and one of the end points are connected via a plane.

In one or more embodiments, the vertex and one of the end points are connected via a convex smooth curved surface.

In one or more embodiments, the vertex and one of the end points are connected via a concave smooth curved surface.

In one or more embodiments, a side surface of the protrusion is perpendicular to the top plate and the bottom plate.

In one or more embodiments, a side surface of the protrusion connecting to the top plate and the bottom plate is an inclined surface or a curved surface.

In one or more embodiments, the protrusion has a vertex. The shapes of both sides of the vertex are asymmetrical.

In one or more embodiments, the protrusion has a vertex. The shapes of both sides of the vertex are symmetrical.

In one or more embodiments, the centrifugal fan further includes a plurality of air inlets disposed at the top plate.

In one or more embodiments, the centrifugal fan further includes a plurality of air inlets disposed at the bottom plate.

In one or more embodiments, the centrifugal fan further includes a stator and a rotor. The stator is disposed on the bottom plate. The rotor is disposed in the stator and connected to the impeller.

In one or more embodiments, the protrusion and the shell are integrally formed.

In one or more embodiments, the centrifugal fan further includes a fixing component for fixing the protrusion to the shell.

By installing the protrusion, which is different from the tongue portion, on the inner wall of the centrifugal fan, the noise generated by the blade frequency is effectively reduced, and the air amount does not change significantly as well, such that the dilemma between the noise and the heat-dissipating efficiency is solved.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
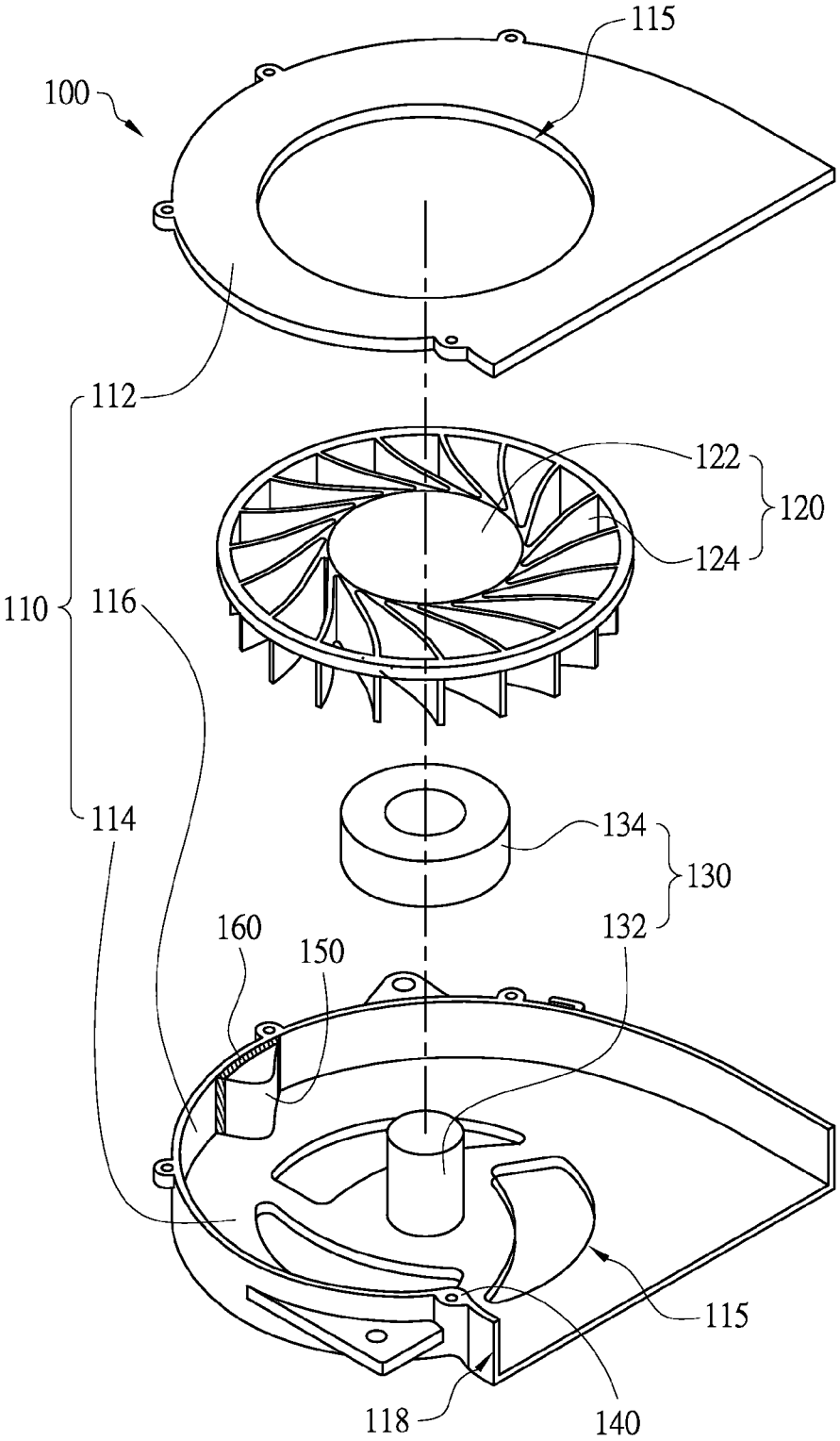
FIG. 1A is a exploded view of a centrifugal fan according to one embodiment of this invention.

Reference will now be made in detail to the present embodiments of the invention, examples of which are illustrated in the accompanying drawings. Wherever possible, the same reference numbers are used in the drawings and the description to refer to the same or like parts.

Figure 1B:
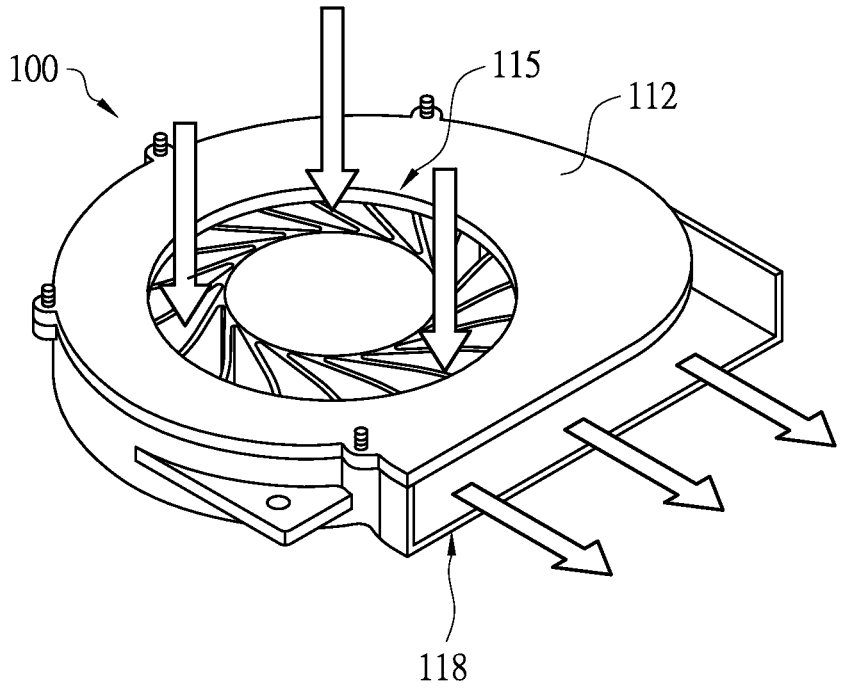
FIG. 1B is a perspective view of the centrifugal fan according to one embodiment of this invention.

FIG. 1A is an exploded view of a centrifugal fan according to one embodiment of this invention, and FIG. 1B is a perspective view of the centrifugal fan according to one embodiment of this invention. A centrifugal fan 100 includes a shell 110, an impeller 120 and a motor 130. The shell 110 includes a top plate 112, a bottom plate 114, and a sidewall 116 connecting to the top plate 112 and the bottom plate 114. The impeller 120 includes a hub 122 and a blade structure 124 connecting to the hub 122. The motor 130 includes a stator 132 disposed on the bottom plate 114 and a rotor 134 disposed in the stator 132. The hub 122 is connected to the rotor 134, and the hub 122 and the rotor 134 are sleeved over the stator 132.

The shell 110 includes an air outlet 118, and the top plate 112, the bottom plate 114, and the sidewall 116 define the air outlet 118. The shell 110 further includes an air inlet 115 disposed at the top plate 112 or the bottom plate 114. The airflow direction in the air inlet 115 is perpendicular to the airflow direction in the air outlet 118. After entering the shell 110 from the air inlet 115, the air moves in the runner along the predetermined direction, and then the air is exhausted from the air outlet 118.

The centrifugal fan 100 includes a tongue portion 140, and the shell 110 is volute-shaped, so that the tongue portion 140 can be formed in the shell 110. The tongue portion 140 is a concave section for compressing airflow, such that airflow moves along a predetermined direction. The tongue portion 140 is disposed near the air outlet 119.

The centrifugal fan 100 further includes at least one protrusion 150. The protrusion 150 is disposed on an inner wall of the shell 110 and physically connected to the top plate 112 and the bottom plate 114. The position of the protrusion 150 does not overlap with the tongue portion 140, and the protrusion 150 is disposed on one side of the tongue portion 140. When the compressed airflow moves in the runner, the airflow passes by the tongue portion 140, then the airflow passes by the protrusion 150, and finally the airflow is exhausted from the air outlet 118.

Through disposing the protrusion 150 in the shell 110 of the centrifugal fan 100, the airflow direction in the flow field and the pressure distribution can be adjusted, so as to reduce the noise made by the blade frequency.

The material of the protrusion 150 can be metal or plastic. In this embodiment, the protrusion 150 is independent from the assembly of the shell 110 and is connected to the shell 110 with fixing component 160 such as adhesive. In other embodiments, the protrusion 150 and the shell 110 are integrally formed, or the independent protrusion 150 can be connected to the shell 110 by riveted joints.

Figure 2:
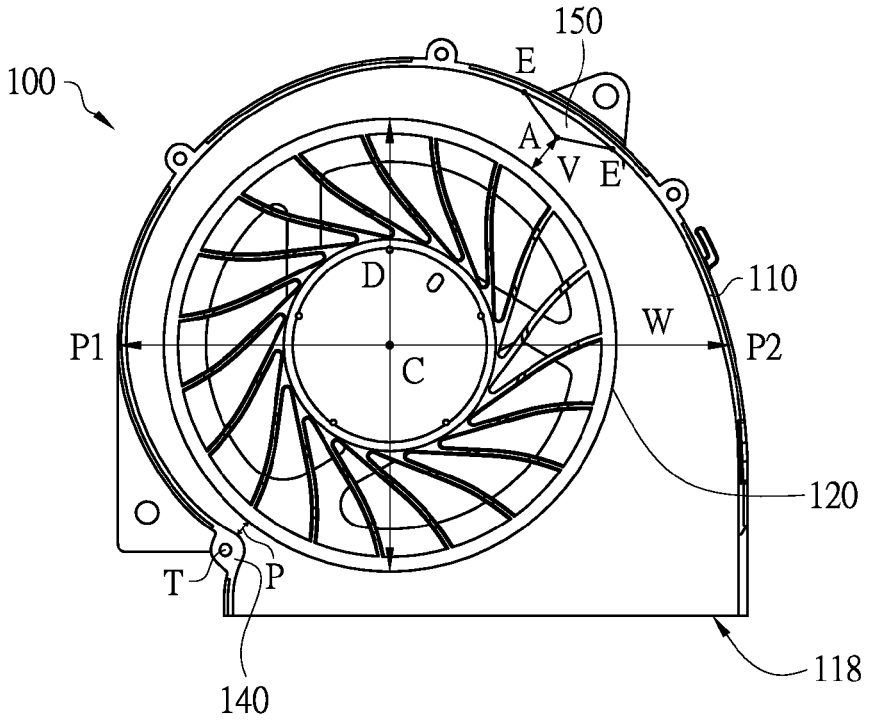
FIG. 2 to FIG. 7 are top views of the centrifugal fan according to different embodiments of this invention.

FIG. 2 is a top view of the centrifugal fan according to one embodiment of this invention. For clarity, the top plate 112 is not shown in all top views.

In the centrifugal fan 100, the impeller 120 has a central point C, and the tongue portion 140 has a central point T. The disposition position of the protrusion 150 needs to be separated from the tongue portion 140 by a certain distance. The protrusion 150 is disposed in a range of 15 degrees to 195 degrees starting inwardly from a C-T connecting line. The protrusion 150 is preferably disposed in the range of 45 degrees to 150 degrees starting inwardly from the C-T connecting line. If the protrusion 150 is disposed in the range, the characteristic performance of the fan will be enhanced. The number of protrusion 150 can be one or more.

The protrusion 150 includes a vertex V and two end points E and E'. The vertex V is a point of the protrusion 150 which is the nearest to the impeller 120, and the two end points E and E' are two ends of the protrusion 150 which is the farthest to the impeller 120. The size of the protrusion 150 is basically decided by the three points. The angle between two connection lines of the two end points E and E' and the vertex V is not larger than 160 degrees. The end point E is on the windward side of the protrusion 150, and the end point E' is on the downwind side of the protrusion 150. In other words, the end point E is the end point nearer to the tongue portion 140, and the end point E' is the end point farther to the tongue portion 140.

There is a minimum distance P between the tongue portion 140 and outer edge of the impeller 120. The shell 110 has a width W, and the width W is a segment that passes through the central point C of the impeller 120 and is parallel to the air outlet 118. The segment and the inner wall of the shell 110 have two intersection points P1 and P2, and the distance between the two intersection points P1 and P2 is the width W. The impeller 120 has a diameter D, and the diameter D is the outer diameter of the impeller 120.

A gap A is defined between the impeller 120 and the protrusion 150, and the gap A is the minimum distance between the vertex V of the protrusion 150 and the impeller 120. In order to make protrusion 150 reduce the noise, the gap A between protrusion 150 and the impeller 120 is preferably in a certain range such as $0.5\times P\leq A\leq 0.7\times(W-D)$, where P is a minimum distance between the tongue portion 140 and the impeller 120, W is the width of the shell 110, and D is the diameter of the impeller 120.

In this embodiment, the vertex V of the protrusion 150 and the end point E and E' are connected via a plane, such that the shape of the protrusion 150 of the centrifugal fan 100 approximates a triangle or a fan. The shapes of the protrusion 150 on both sides of the vertex can be symmetrical or asymmetrical. The distance between vertex V and two end points E and E' can be equal or unequal.

FIG. 3 to FIG. 7 are top views of the centrifugal fan according to different embodiments of this invention. The disposition positions of and the relationship between the protrusion 150 and other components are described above, so the following embodiments will describe the variations of the protrusion 150.

Figure 3:
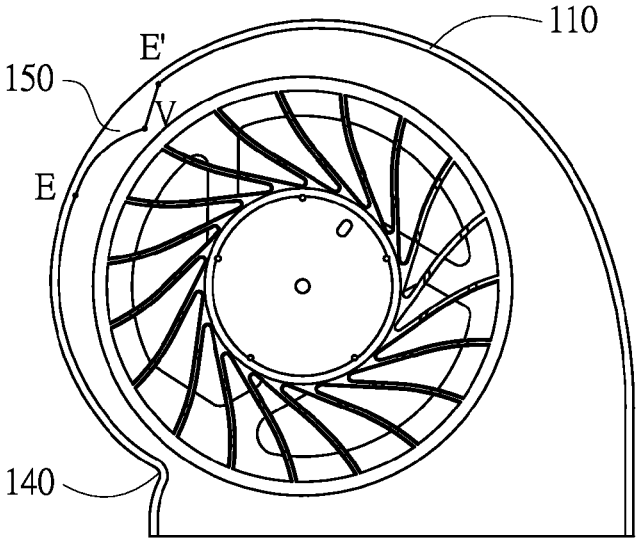

As shown in FIG. 3, the protrusion 150 is disposed on the inner wall of the shell 110, and compared with the protrusion 150 in FIG. 2, the protrusion 150 in this embodiment is nearer to the tongue portion 140. The shapes of the protrusion 150 on the both sides of the vertex are asymmetrical. Specifically, the vertex V of the protrusion 150 is connected to the end point E nearer to the tongue portion 140 via a concave smooth curved surface, and the vertex V is connected to the end point E' farther to the tongue portion 140 via a plane. The distance between the vertex V and the end point E nearer to the tongue portion 140 is larger than that between the vertex V and the end point E' farther to the tongue portion 140.

Figure 4:
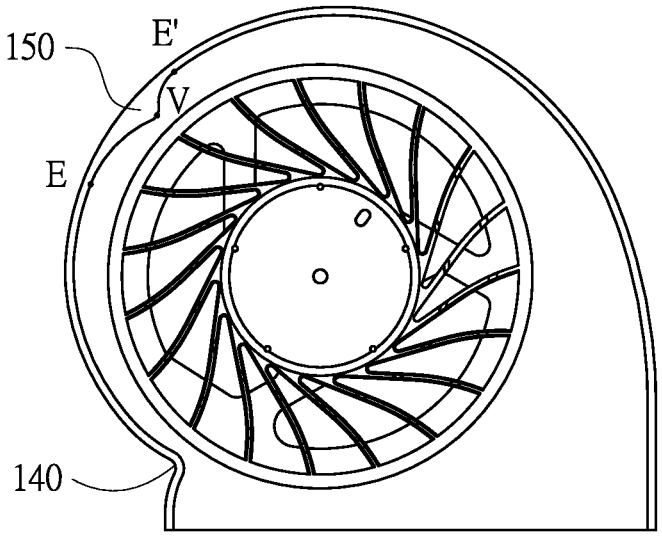
Figure 5:
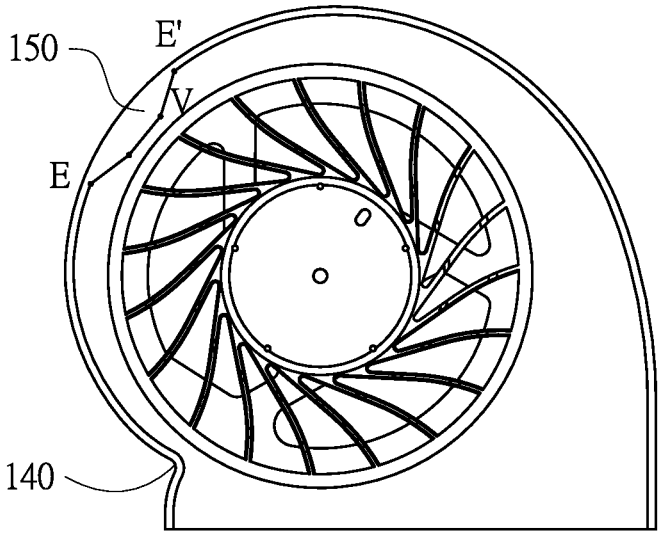
Figure 6:
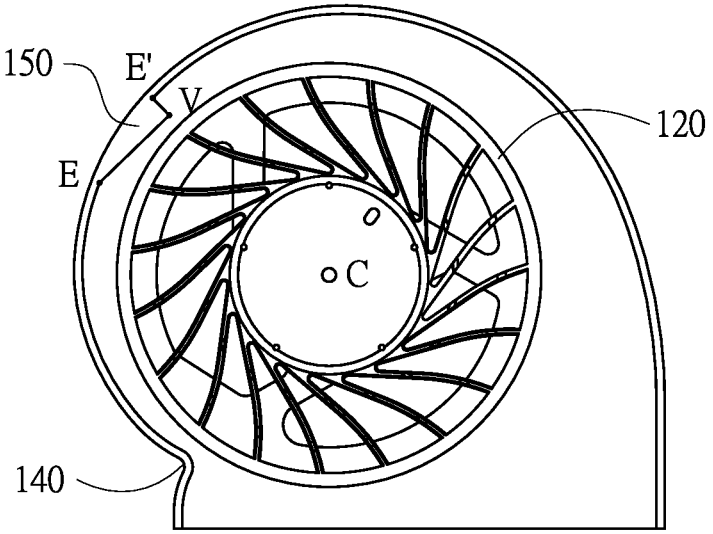
Figure 7:
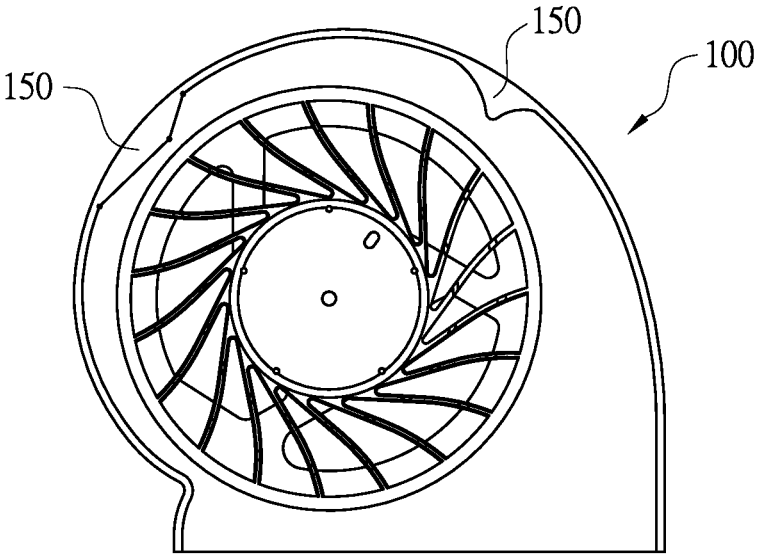

As shown in FIG. 4, the vertex V of the protrusion 150 is connected to the two end points E and E' via a concave smooth curved surfaces respectively, and the distance between the vertex V and the end point E nearer to the tongue portion 140 is larger than that between the vertex V and the end point E' farther to the tongue portion 140. As shown in FIG. 5, the vertex V of the protrusion 150 can also be connected to the two end point E and E' via a plurality of planes, and the distance between the vertex V and the end point E nearer to the tongue portion 140 is larger than that between the vertex V and the end point E' farther to the tongue portion 140. As shown in FIG. 6, the end point E' farther to the tongue portion 140 of protrusion 150, the vertex V of the protrusion 150, and the central point C of the impeller 120 are disposed on the same line, and the vertex V is connected to the end point E' farther to the tongue portion 140 via a plane. The vertex V and the end point E nearer to the tongue portion 140 can be connected via a plane or a curved surface. As shown in FIG. 7, a plurality of protrusion 150 can be disposed in each centrifugal fan 100, and the shapes of the protrusions 150 can be the same or different.

Figure 8A:
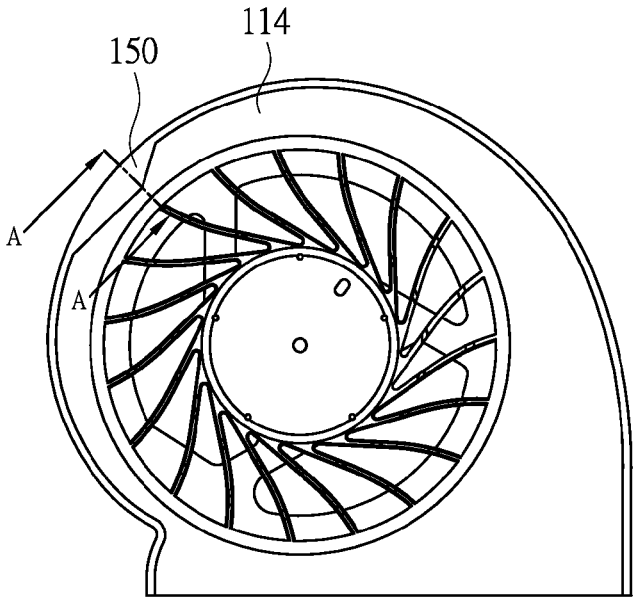
FIG. 8A to FIG. 11B are top views and cross-sectional views taken along line A-A of the centrifugal fan according to different embodiments of this invention.
Figure 8B:
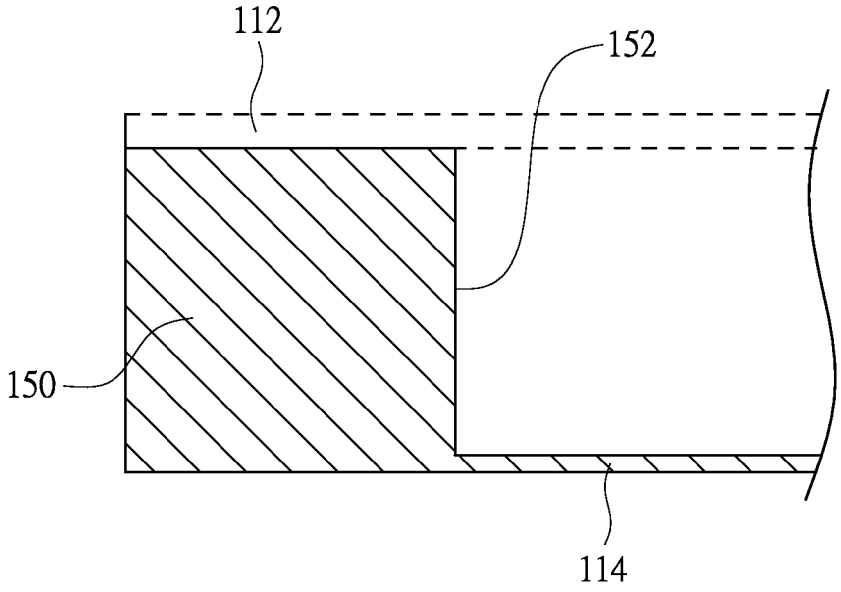

FIG. 8A to FIG. 11B are top views and cross-sectional views taken along line A-A of the centrifugal fan according to different embodiments of this invention. As shown in FIG. 8A and FIG. 8B, a side surface 152 of the protrusion 150 can be perpendicular to the top plate 112 and the bottom plate 114. That is, the shape and the area of the surface of the protrusion 150 connecting to the top plate 112 and the shape and the area of the surface of the protrusion 150 connecting to the bottom plate 114 are the same.

Figure 9A:
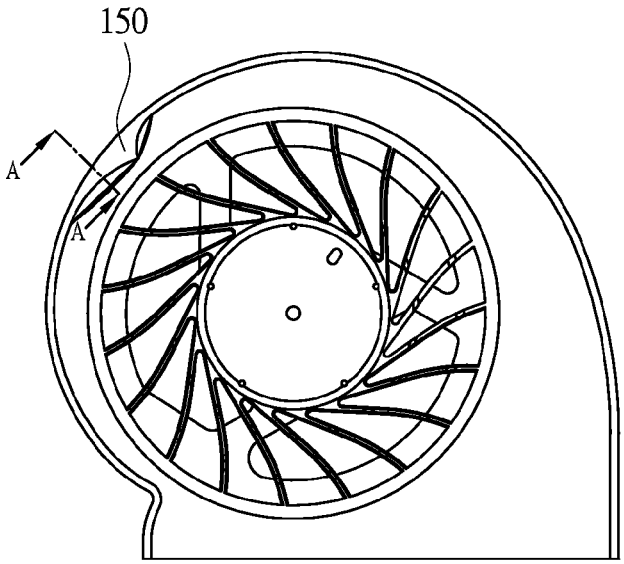
Figure 9B:
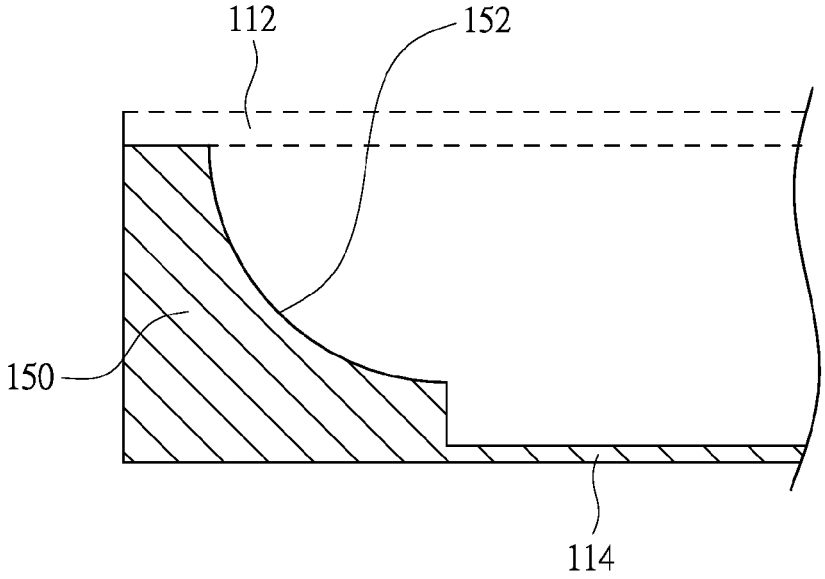

As shown in FIG. 9A and FIG. 9B, the side surface 152 of the protrusion 150 connecting to the top plate 112 and the bottom plate 114 can be concave curved surface. The area of the surface of the protrusion 150 connecting to the top plate 112 can be smaller or larger than the area of the surface of the protrusion 150 connecting to the bottom plate 114. The shape of the surface of the protrusion 150 connecting to the top plate 112 and the shape of the surface of the protrusion 150 connecting to the bottom plate 114 are the same or different.

Figure 10A:
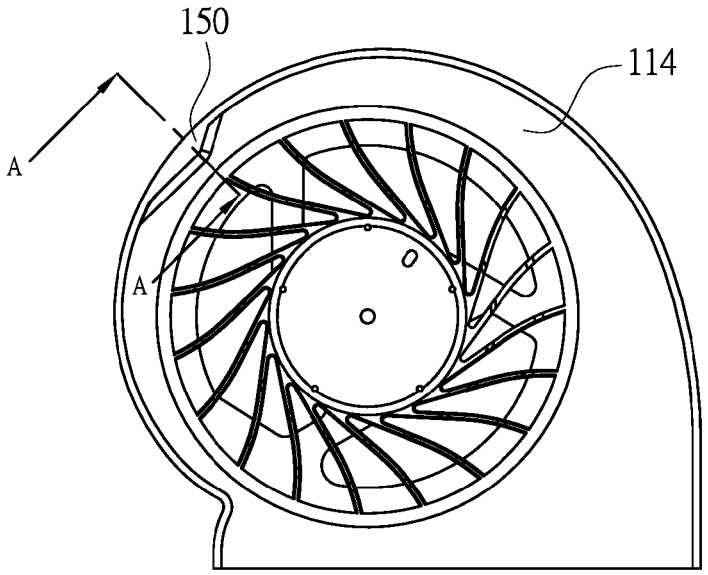
Figure 10B:
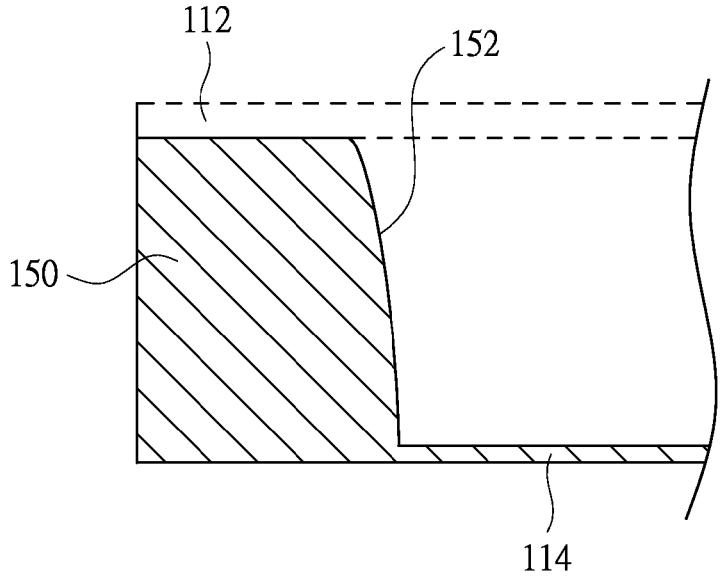

As shown in FIG. 10A and FIG. 10B, the side surface 152 of the protrusion 150 connecting to the top plate 112 and the bottom plate 114 can be a convex curved surface. The area of the surface of the protrusion 150 connecting to the top plate 112 can be smaller or larger than the area of the surface of the protrusion 150 connecting to the bottom plate 114. The shape of the surface of the protrusion 150 connecting to the top plate 112 and the shape of the surface of the protrusion 150 connecting to the bottom plate 114 are the same or different.

Figure 11A:
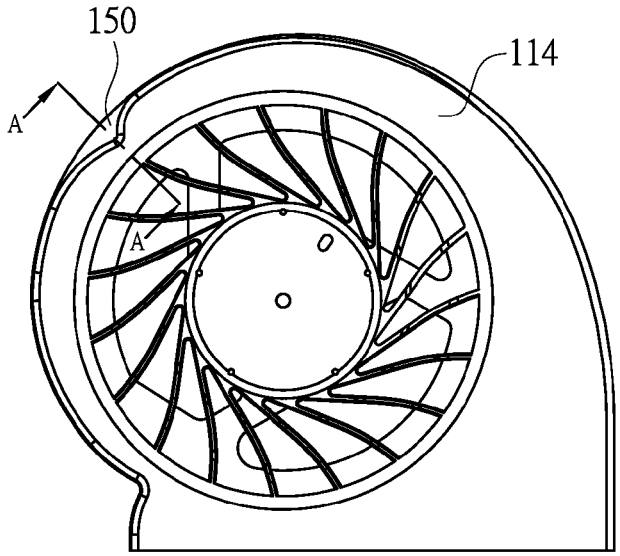
Figure 11B:
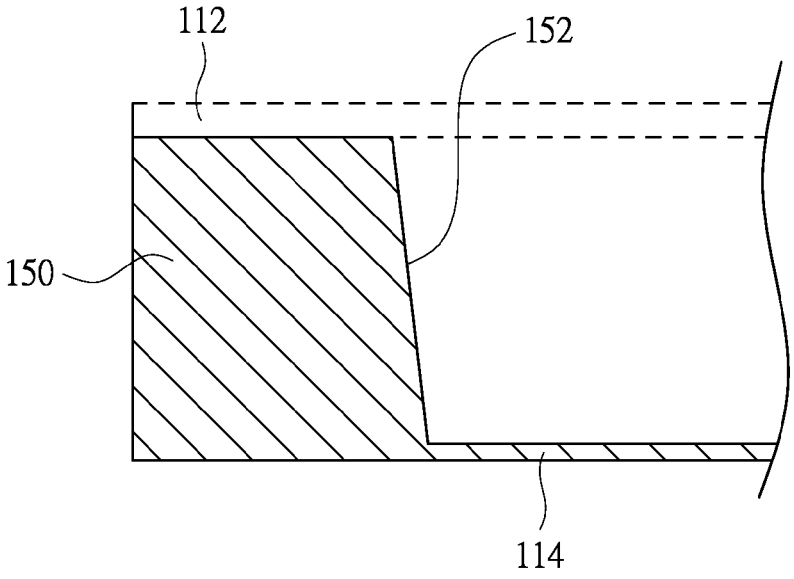

As shown in FIG. 11A and FIG. 11B, the side surface 152 of the protrusion 150 connecting to the top plate 112 and the bottom plate 114 can be an inclined surface. The area of the surface of the protrusion 150 connecting to the top plate 112 can be smaller or larger than the area of the surface of the protrusion 150 connecting to the bottom plate 114. The shape of the surface of the protrusion 150 connecting to the top plate 112 and the shape of the surface of the protrusion 150 connecting to the bottom plate 114 are the same or different, and the inclined angle of the inclined surface is preferably not larger than 25 degrees.

Figure 12:
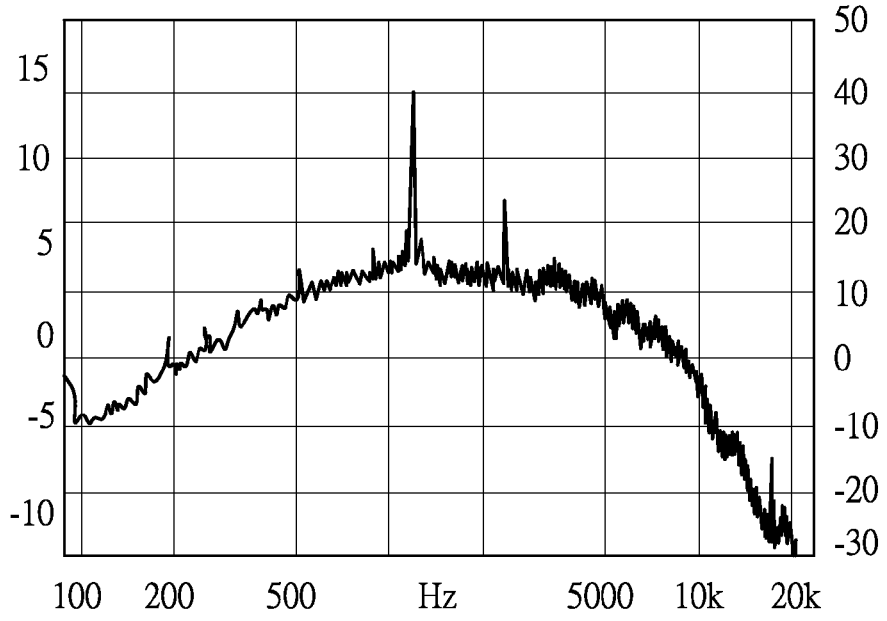
FIG. 12 is a noise test figure of a traditional centrifugal fan without a protrusion.
Figure 13:
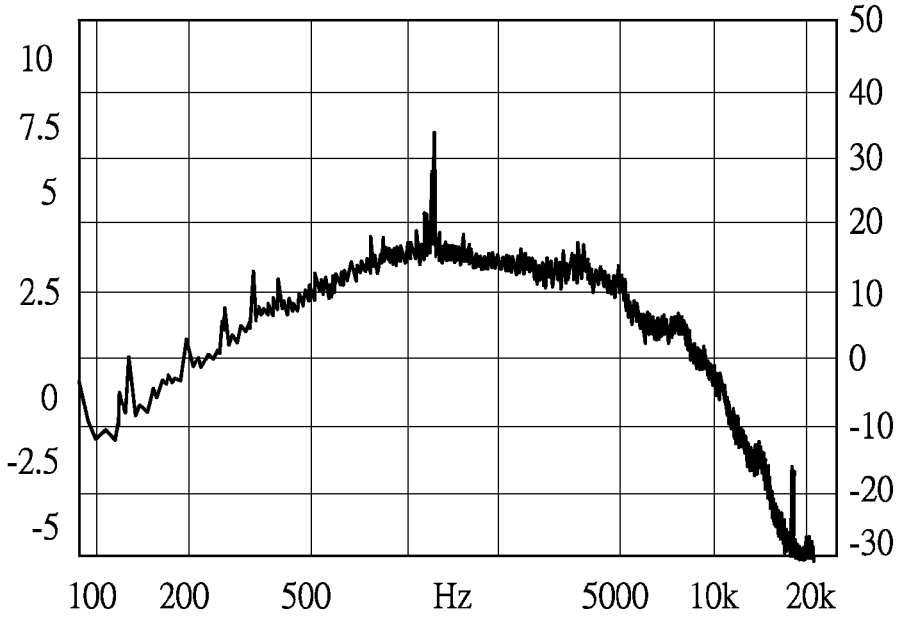
FIG. 13 and FIG. 14 are noise test figures of the centrifugal fan with a protrusion according to different embodiments of this invention.
Figure 14:
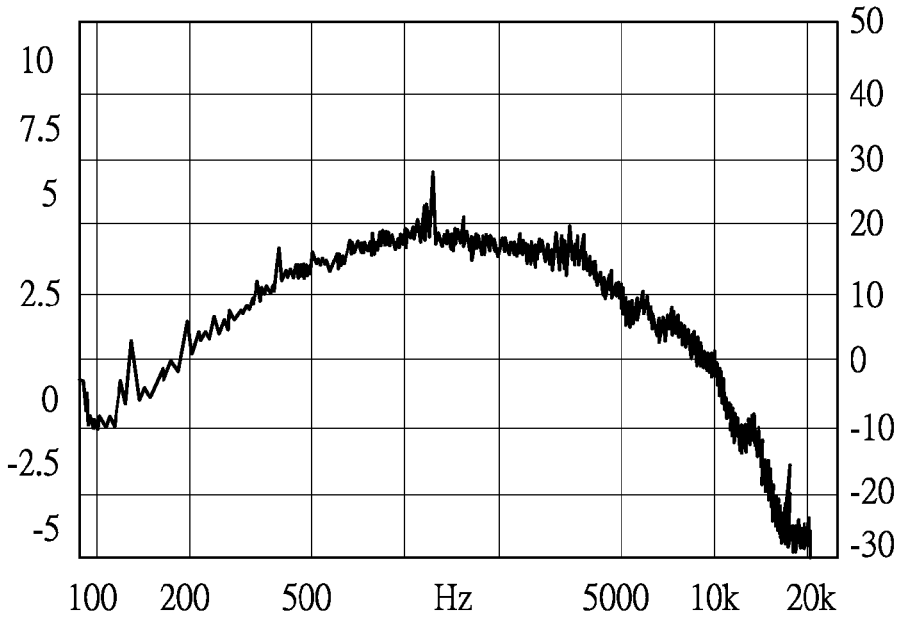

The centrifugal fan 100 can effectively reduce the noise caused by the blade frequency via the protrusion 150. FIG. 12 is a noise test figure of a traditional centrifugal fan without a protrusion, and FIG. 13 and FIG. 14 are noise test figures of the centrifugal fan with a protrusion according to different embodiments of this invention. The horizontal axis represents blade frequency, and the vertical axis represents noise level. In FIG. 13 or FIG. 14, the centrifugal fan includes one protrusion, and the deposition position of the protrusion is the same as in the FIG. 2. The gap A between the impeller and the protrusion is 2 mm in FIG. 13, and the gap A between the impeller and the protrusion is 0.8 mm in FIG. 14. Among the figures, compared with the traditional centrifugal fan without the protrusion, the centrifugal fan with the protrusion can reduce the noise, and the reduced noise level is relative to the gap between the impeller and the protrusion.

Figure 15:
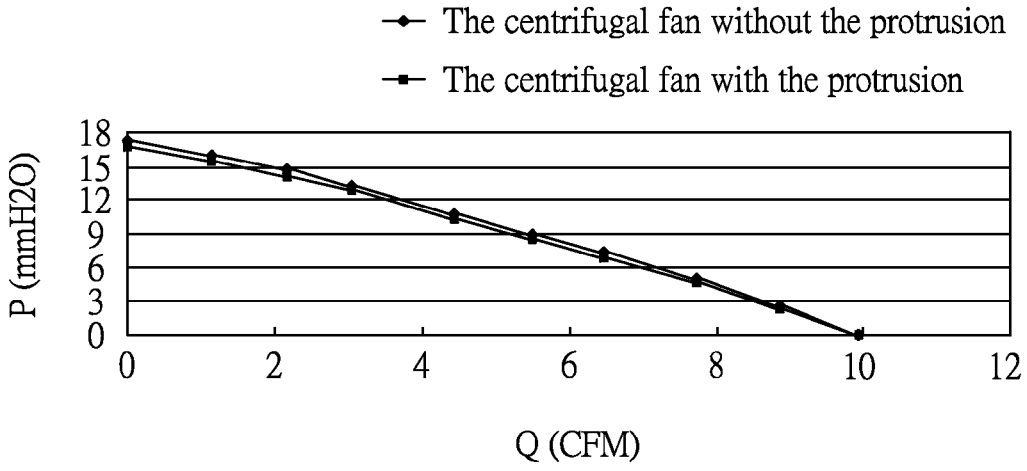
FIG. 15 is an air amount to air pressure test figure of the traditional centrifugal fan and the centrifugal fan according to one embodiment of this invention.

FIG. 15 is an air amount to air pressure test figure of the traditional centrifugal fan and the centrifugal fan according to one embodiment of this invention. The horizontal axis represents air amount, and the vertical axis represents air pressure. The centrifugal fan with the protrusion includes one protrusion, and the deposition position of the protrusion is the same as in FIG. 4. Among the figures, compared with the traditional centrifugal fan without the protrusion, though the air pressure about the centrifugal fan with the protrusion slightly decreases, the air amount about the centrifugal fan with the protrusion does not change significantly.

By installing the protrusion, which is different from the tongue portion, on the inner wall of the centrifugal fan, the noise generated by the blade frequency is effectively reduced, and the air amount does not change significantly as well, such that the dilemma between the noise and the heat-dissipating efficiency is solved.

Although the present invention has been described in considerable detail with reference to certain embodiments thereof, other embodiments are possible. Therefore, their spirit and scope of the appended claims should no be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A centrifugal fan comprising:

a shell comprising:

a top plate;

a bottom plate; and a sidewall connecting to the top plate and the bottom plate, wherein the top plate, the bottom plate, and the sidewall define an air outlet;

an impeller disposed in the shell;

a tongue portion disposed in the shell and neighboring the air outlet; and a protrusion disposed on an inner wall of the shell and physically connected to the top plate and the bottom plate;

wherein there is a minimum distance P between the tongue portion and the impeller; the shell has a width W, the impeller has a diameter D, and a gap A is defined between the impeller and the protrusion, in which $0.5\times P \le A \le 0.7\times(W-D)$.

2. The centrifugal fan of claim 1, wherein the impeller has a central point C, the tongue portion has a central point T, and the protrusion is disposed in a range of 15 degrees to 195 degrees starting inwardly from a C-T connecting line.

3. The centrifugal fan of claim 2, wherein the protrusion is disposed in the range of 45 degrees to 150 degrees starting inwardly from the C-T connecting line.

4. The centrifugal fan of claim 1, wherein the protrusion includes a vertex and two end points, wherein the vertex is a point of the protrusion nearest to the impeller, the two end points are two ends of the protrusion farthest from the impeller, and an angle between two connecting lines of the two end points and the vertex is not larger than 160 degrees.

5. The centrifugal fan of claim 4, wherein the vertex and one of the end points are connected via a plane.

6. The centrifugal fan of claim 4, wherein the vertex and one of the end points are connected via a smoothly-curved convex surface.

7. The centrifugal fan of claim 4, wherein the vertex and one of the end points are connected via a smoothly-curved concave surface.

8. The centrifugal fan of claim 1, wherein a side surface of the protrusion is perpendicular to the top plate and the bottom plate.

9. The centrifugal fan of claim 1, wherein a side surface of the protrusion connecting to the top plate and the bottom plate is an inclined surface or a curved surface.

10. The centrifugal fan of claim 9, wherein an inclined angle of the inclined surface is not larger than 25 degrees.

11. The centrifugal fan of claim 1, wherein the protrusion has a vertex, and shapes of both sides of the vertex are asymmetrical.

12. The centrifugal fan of claim 1, wherein the protrusion has a vertex, and shapes of both sides of the vertex are symmetrical.

13. The centrifugal fan of claim 1, further comprising a plurality of air inlets disposed at the top plate.

14. The centrifugal fan of claim 1, further comprising a plurality of air inlets disposed at the bottom plate.

15. The centrifugal fan of claim 1, further comprising:

a stator disposed on the bottom plate; and a rotor disposed in the stator and connected to the impeller.

16. The centrifugal fan of claim 1, wherein the protrusion and the shell are integrally formed.

17. The centrifugal fan of claim 1, further comprising a fixing component for fixing the protrusion to the shell.

18. The centrifugal fan of claim 1, wherein a material of the protrusion is metal or plastic.

19. The centrifugal fan of claim 1, wherein the protrusion includes a plurality of the protrusions respectively physically connected to the top plate and the bottom plate.

* * * * *